US005897405A

United States Patent [19]

Endo

[11] Patent Number: 5,897,405

[45] Date of Patent: Apr. 27, 1999

[54] ELECTRICAL SOCKET CONTACT

[76] Inventor: Hiroshi Endo, 27041 Via Ovied, Mission Viejo, Calif. 92691

[21] Appl. No.: 08/865,406

[22] Filed: May 29, 1997

[51] Int. Cl.[6] ..... H01R 11/22

[52] U.S. Cl. ..... 439/852

[58] Field of Search ..... 439/851, 852, 439/843, 845, 381; 479/848

[56] References Cited

U.S. PATENT DOCUMENTS

| | | | |
|---|---|---|---|
| 3,963,302 | 6/1976 | Gourley . | |
| 4,136,923 | 1/1979 | Spaulding . | |
| 4,540,233 | 9/1985 | Saijo et al. . | |
| 4,564,259 | 1/1986 | Vandame | 439/852 OR |
| 4,681,382 | 7/1987 | Lockhard . | |
| 4,838,816 | 6/1989 | Matsusaka et al. . | |
| 4,919,628 | 4/1990 | Mobeley et al. . | |
| 5,112,254 | 5/1992 | Endo . | |
| 5,158,485 | 10/1992 | Saito et al. . | |
| 5,271,741 | 12/1993 | Saito et al. . | |
| 5,443,592 | 8/1995 | Ittah et al. . | |
| 5,601,458 | 2/1997 | Ohsumi et al. . | |
| 5,643,018 | 7/1997 | Sakai et al. | 439/852 OR |

*Primary Examiner*—Gary Paumen
*Assistant Examiner*—Daniel Wittels
*Attorney, Agent, or Firm*—Curtis L. Harrington

[57] ABSTRACT

A new and improved electrical socket contact has good structural integrity and a design which forestalls the possibility of having a male contact inadvertently inserted behind the spring contact. This is accomplished first through an overall design in which a spring contact section is completely surrounded by four side walls and a back wall, the walls having a generally box-like configuration. The spring section has a pair of overlying spring members, the innermost member having an overlying spring assist portion. The portion of the innermost spring portion nearest the socket opening is protected by a curved end portion of an overlying wall which also acts to protect the spring section. The socket contact of the present invention is formed from a single piece of flat material and is formed through several folding steps to achieve the final construction. The socket contact formed enables a high reliability very miniaturized contact.

13 Claims, 4 Drawing Sheets

ELECTRICAL SOCKET CONTACT

FIELD OF THE INVENTION

This invention relates generally to electrical contacts, and more particularly to an electrical socket contact made from a single piece of material in which a male contact member is prevented from damaging the spring contact element.

BACKGROUND OF THE INVENTION

A wide variety of pin and socket contacts are known, and have a similar variety of active structures which must mechanically cooperate to give an adequate surface area of electrical contact, as well as provide mechanical holding integrity. It is relatively easy to satisfy these goals in a connector of sufficient size where the material strengths are adequate. However for very small female contacts which are smaller than about ½ inch in length and have to exist in a densely packed area, have very small magnitude of the other dimensions, which may be much less than ⅛ of an inch. Smaller dimensioning translates into thinner material, and the goals of small size and strength are more difficult to achieve.

The electrical contact within a socket connector is insured by the use of a spring member to bear against the male member when inserted into the socket. The spring member may be provided separately or extend from the front mouth of the socket. In both cases, and especially where the socket and pin are small, the male pin member might be inadvertently wedged behind the spring member rather than against the side of the spring member intended for contact.

This unintended wedging action can destroy the spring member, and the socket contact if the wedging is violent enough. Even where the wedging is not violent, where the spring member is bent across the mouth of the contact, the contact becomes unusable. Further poking with the male contact will further damage the contact, and the technician, if available, will have to spend significant time replacing the contact, since repair of the contact, even if it were possible, would not leave it in a reliable condition.

Where a female socket contact consists of three walls and uses the fourth wall, opposing the middle of the three walls, as its spring contact, the chances for jamming are significant. In today's zero defects environment, the miniaturization of contacts is limited by this type of significant failure rate.

What is therefore needed is a contact which is inexpensive, has high reliability generally, good contact and especially which forestalls the possibility of inadvertent insertion of the pin behind the spring member.

SUMMARY OF THE INVENTION

In the preferred embodiment, a new and improved electrical socket contact has good structural integrity and a design which forestalls the possibility of having a male contact inadvertently inserted behind the spring contact. This is accomplished first through an overall design in which a spring contact section is completely surrounded by four side walls and a back wall, the walls having a generally box-like configuration. The spring section has a pair of overlying spring members, the innermost member having an overlying spring assist portion. The portion of the innermost spring portion nearest the socket opening is protected by a curved end portion of an overlying wall which also acts to protect the spring section. The socket contact of the present invention is formed from a single piece of flat material and is formed through several folding steps to achieve the final construction. The socket contact formed enables a high reliability very miniaturized contact.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
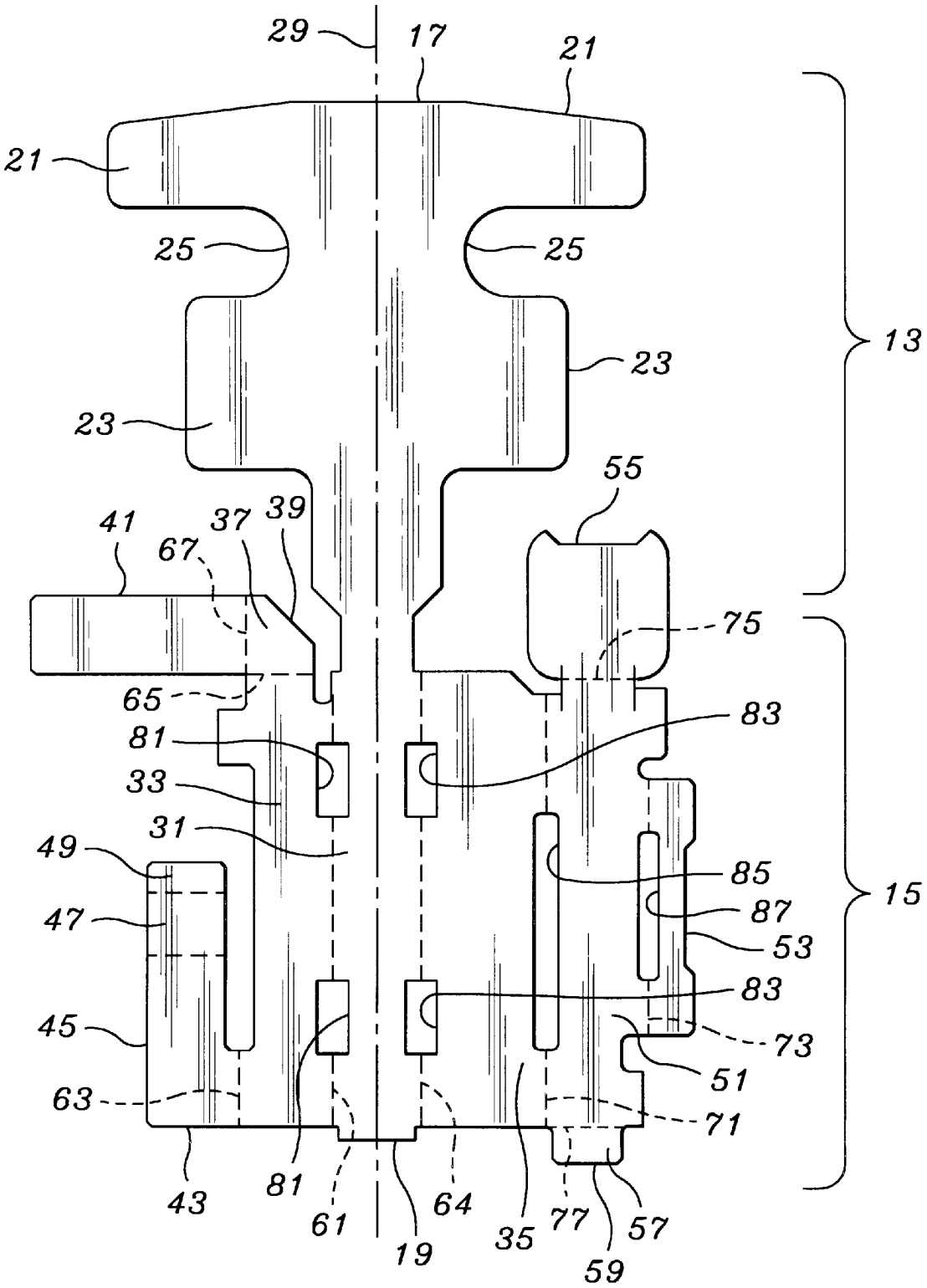
FIG. 1 is an illustration of the generally planar starting shape of metal material punched from a sheet of metal and which is the starting form in the process of forming the socket contact.

The description and operation of the invention will be best described with reference to an inventive configuration which shown in FIG. 1. FIG. 1 illustrates a starting blank 11 which is made from a sheet of conductive material, preferably a resilient metal. The punching process may at the outset involve carrier strips left over after the blank 11 is punched, and these carrier strips may remain with the blank 11 during its processing and until its final formation. The shape and location of any carrier strip is a matter of choice during formation.

The blank 11 has a crimping portion designated by the numeral 13 and a socket portion indicated by the numeral 15. The upper end of the crimping portion 13 has a first break surface 17, and the lower end of the socket portion 15 has a second break surface 19, from which separation from a carrier strip may be accomplished.

The crimping portion 13 is designed to receive a solderless electrical wire, and will be bent to a final shape upon attachment to a wire. The crimping portion includes a pair of extended insulation cover holding portions 21 and a pair of wire contact receiving portions 23, the separation between portions 21 and 23 by a pair of notches 25. The wire contact receiving portions 23 taper into a transition portion 29 at the end of the crimping portion, and which transitions into the socket portion 15.

At the left side of FIG. 1, the socket portion 15 is divided by dashed lines into a base portion 31, a first side wall 33 adjacent the base portion 31 and a second side wall 35, adjacent the base portion 31 and opposite the first side wall 33.

The first side wall 33 nearer the crimping portion 13 transitions into an outer spring base 37 having an angle cut 39, and then into an outer spring arm 41. The first side wall 33 at the end of the socket portion 15 opposite the crimping portion 13 transitions into an inner spring base 43 and then into an inner spring arm 45. Inner spring arm 45 is formed with a pair of surfaces which are angled differently than the remainder of both the inner spring arm 45 and the other areas of the blank 11, and these surfaces are formed preferably at the time the blank 11 is punched, with the punching die providing surfaces which cause the bending into the different surfaces. From the perspective seen in FIG. 1, the main portion of the inner spring arm 45 transitions into an upwardly sloping portion 47, and the upwardly sloping portion 47 terminates in an elevated portion 49 which is roughly parallel to the other surfaces of the blank except for portion 47, but elevated due to dependence from the upwardly sloping portion 47. As will be seen, this arrangement provides advantage to the completed socket contact.

Second side wall 35 is adjacent and supports a top wall 51, which lies adjacent and supports a closure flap 53. At the end of the top wall 51 and nearest the crimping portion 13, a back cover portion 55.

At the bottom right side of the socket portion 15, a protection tab 57 extends slightly beyond the end of the socket portion 15 opposite the crimping portion 13, terminating in an edge 59. This protection tab 57 is a feature which will assist in preventing an improper insertion of a male pin member into the finished socket.

The dashed lines shown in FIG. 1 are folds and correspond to some open spaces in the blank 11. The open spaces help to set the strength of a fold where the fold axis extends through one or more of the open spaces. This technique helps to place the folds more accurately. The folds are identified with reference to the sequence of folding of the blank 11, although in some instances some folds could be made before others. The folds include fold 61 between the base portion 31 and the first side wall 33, fold 63 between the first side wall 33 and the inner spring base 43, and fold 65 between the outer spring base 37 and the first side wall 33. The folds 61, 63 and 65 could be made in any order.

Next is fold 67 between the outer spring arm 41 and the outer spring base 37. Fold 69 is between the base portion 31 and the second side wall 35, and fold 71 is between the second side wall 35 and the top wall 51. Fold 73 is between the top wall 51 and the closure flap 53. A fold 75 is located between the end of the top wall 51 closest to the crimping portion 13, and the back cover portion 55. Finally, a fold 77 is located between the top wall 51 and the protection tab 57.

A series of rectangular slots are formed in the blank 11 to facilitate the folding of the material along some, but not all of the folds, and is present at folds 61, 69, 71, and 73. A pair of slots 81 are located along fold 61, and a pair of slots 83 are located along fold 69. An elongate slot 85 is located along fold 71, and a slightly shorter elongate slot 87 is located along fold 73.

Figure 2:
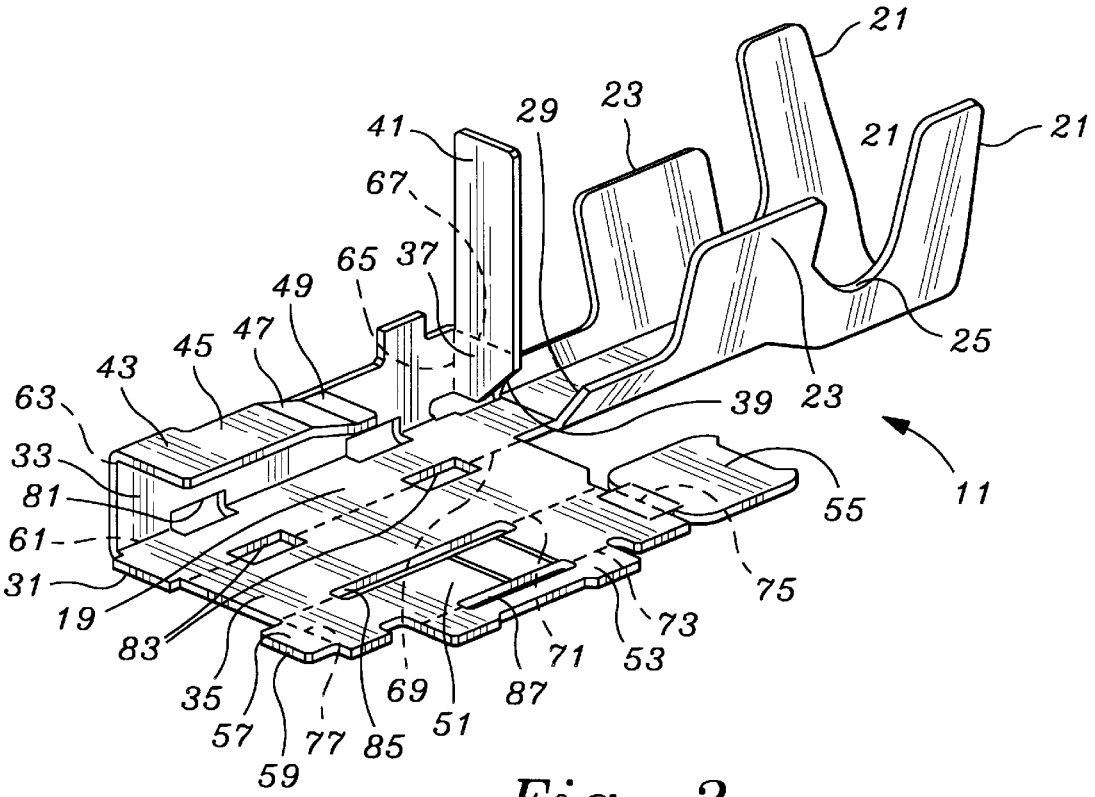
FIG. 2 illustrates the formation of the socket contact after the crimping portion has been formed and after the contact portion has three folds.

Referring to FIG. 2, the curved folding of the pair of extended insulation cover holding portions 21, pair of wire contact receiving portions 23, and area immediately adjacent the pair of notches 25 and area immediately adjacent the transition portion 29, all of the crimping portion 13, has been accomplished. The pair of extended insulation cover holding portions 21, pair of wire contact receiving portions 23 will continue to be folded over to closure only during installation of the resulting socket, the completed folding used to grasp both the insulation cover and conductive wire contact portion of the end of a wire to which the socket will be mechanically and electrically connected.

At the socket portion 15 of the blank 11, the first three folds are made along folds 61, 63, and 65. Since the inner spring arm 45 is sufficiently long that it will lie under the outer spring arm 41, it is should be folded into position first. The material around fold 65 was folded before fold 67 to prevent fold 65 from occurring first which would fold outer spring arm 41 down, and then have it sweep over the inner spring arm 45.

Figure 3:
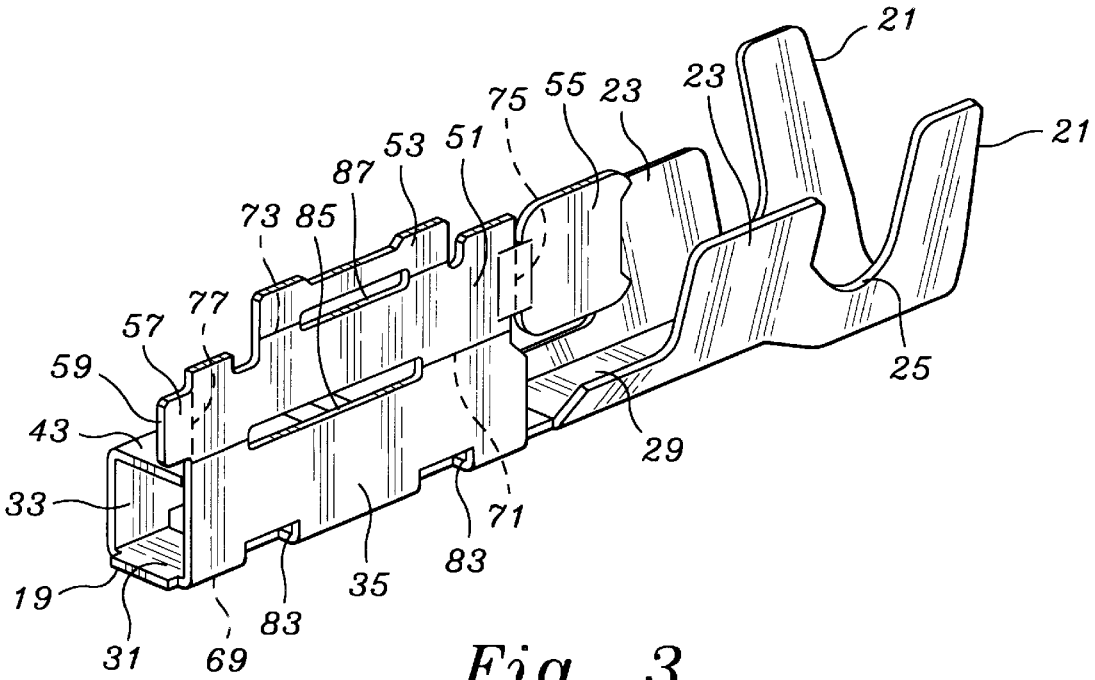
FIG. 3 illustrates the formation of the socket contact after a fourth and fifth fold has been made.

Referring to FIG. 3, a fold of material along the fold 69 has been accomplished, as well as a fold of the outer spring arm 41 along the fold 67, and which cannot be seen behind the second side wall 35, top wall 51 and closure flap 53.

Figure 4:
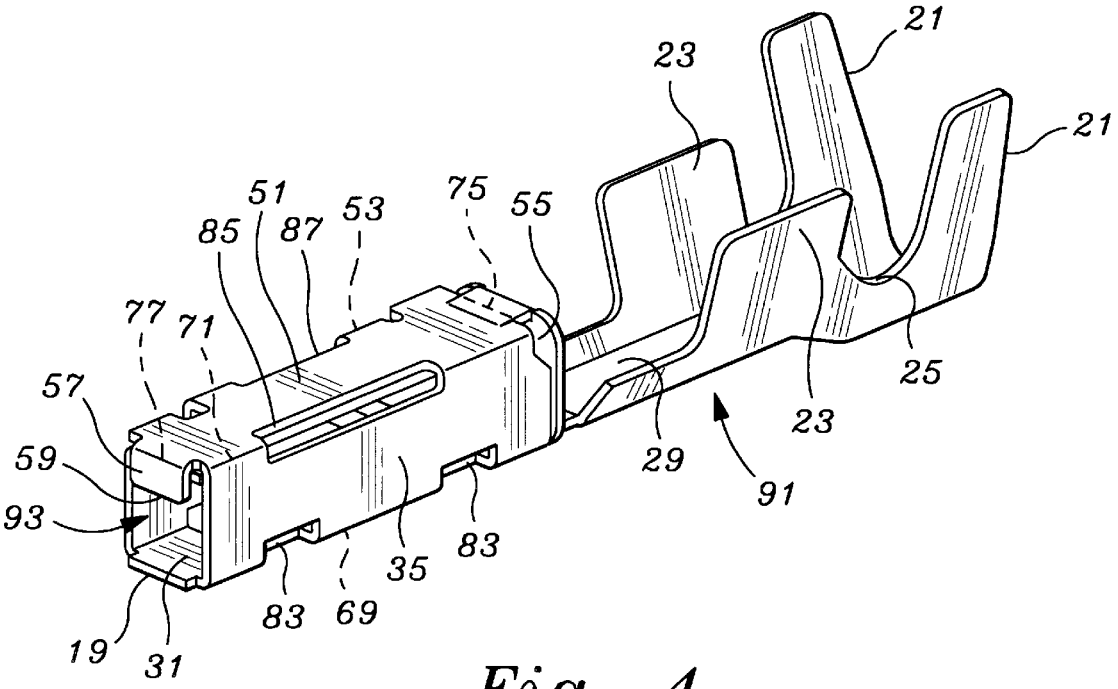
FIG. 4 is a perspective view, from the socket portion end, of the completed socket contact.

Referring to FIG. 4, the folding steps related to the final four folds 71, 73, 75, and 77 are accomplished preferably with folding of the material of fold 71 occurring before folding of materials around folds 73, 75, or 77. Once the folding is completed, the finished female socket contact 91 is formed, and having an entry aperture 93.

Note in the completed socket contact 91 that the protective tab 57 completely covers any space between the inner spring base 43 and the top wall 51 to completely prevent any male contact from being able to move the inner spring base 43 downward into the aperture 93.

FIG. 4 is a perspective view nearer the socket portion 15 end. The entrance of the aperture 93 can be seen as very well protected The lower edge 59 of the protection tab 57 acts in concert with the base portion 31 to guide the entry of a male pin member along the inner surface of the base portion 31.

Figure 5:
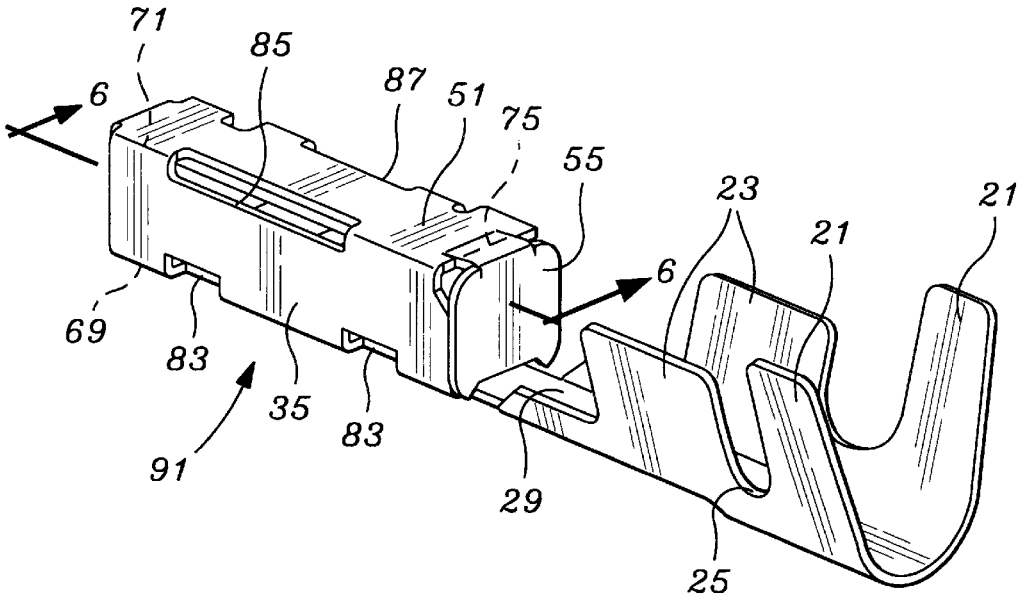
FIG. 5 is a perspective view, from the crimping portion end, of the completed socket contact.
Figure 6:
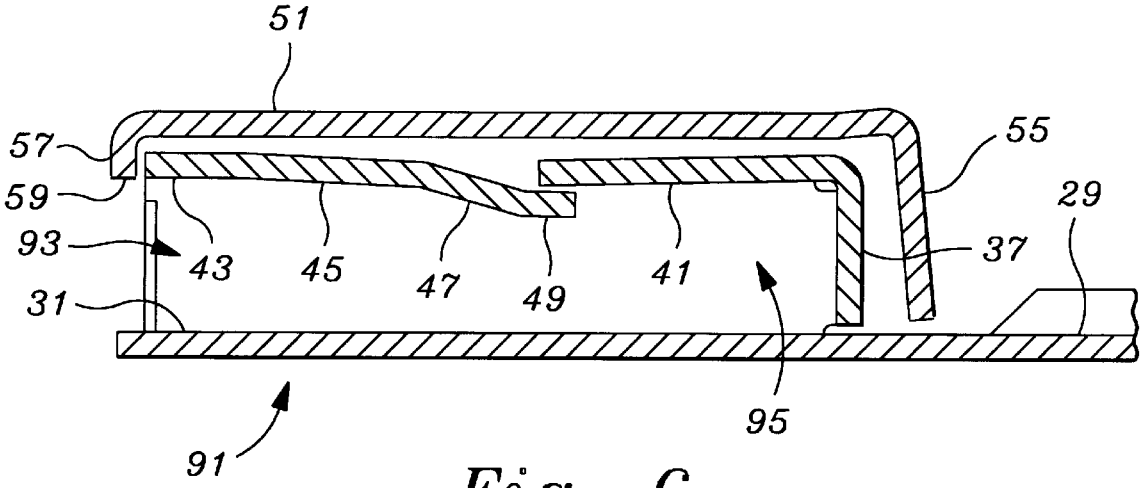
FIG. 6 is a section taken along line 6—6 of FIG. 4 illustrating the spring section in the absence of insertion of a male pin contact member.

Referring to FIG. 6, a section taken along line 6—6 of FIG. 5 shows the relative positioning of the outer spring arm 41, inner spring base 43, and inner spring arm 45. The upwardly sloping portion 47 has been inverted by folding and is now downwardly sloping with respect to the view of FIG. 6. The elevated portion 49 is now a lowered portion 49 and it can be seen that the portion 49 is shifted to accommodate the outer spring arm 41. This configuration has several advantages. Beginning at the left of FIG. 6, the extent to which the protection tab 57 protects the end of the inner spring base 43 is clearly seen. Thus there will be no lateral pressure on the inner spring base which would distort the inner spring 45.

Then note that the narrowest point within an inside area 95 of the socket connector 91 is the innermost surface of the elevated portion 49. In most socket contacts, the spring member extends inward from a point near the entrance of the aperture 93 and thus presents a considerable danger of being bent inward, into the aperture 93. Here, the point of maximum spring intrusion into the inside area 95 occurs about midway through the elongate inside area 95. Thus the male pin is not mechanically engaged until it is half way into the socket connector 91.

Figure 7:
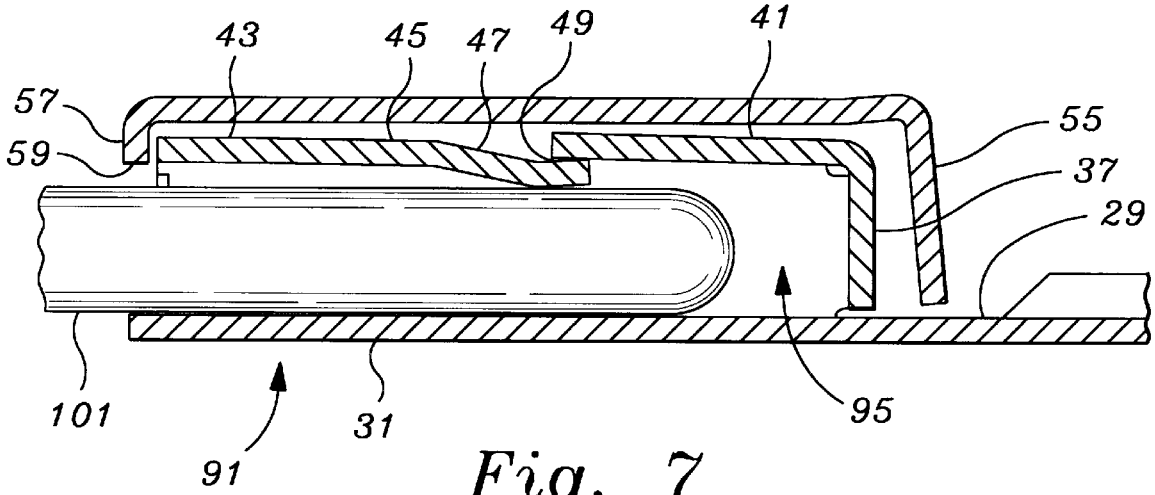
FIG. 7 is an illustration as was seen in FIG. 6 which illustrates the spring section in the presence of the insertion of a male pin contact member.

Note the position of the outer spring arm 41 as lying on top of and possibly contacting the portion 49 opposing the outer spring arm 41. Any upward movement on the portion 49 would move up against the outer spring arm 41 and receive reinforcing support. This action is best shown by comparison with FIG. 7, which is taken from the same perspective as FIG. 6 except for the addition of a male contact member 101 having been inserted through the aperture 93 and past the end of the portion 49. Note that the elevated portion 49 has been displaced upwardly under the influence of the male contact member 101. The elevated portion 49, to the extent that it was not a already contacting the underside of the outer spring arm 41 then contacts the underside of the outer spring arm 41 and displaces the outer spring arm 41 upward. In FIG. 6, the outer spring arm 41 was slightly sloping away from the top wall 51 toward its end. In FIG. 7 it has been upwardly displaced to be nearly linear and parallel with respect to the top wall 51.

It is preferable for the outer spring arm 41 to have sufficient resilient strength not to make contact with the inside surface of the top wall 51, but the top wall 51 does provide a limiting structure to both strengthen the socket contact 91 and to prevent over bending where an operator might inadvertently lever the male contact member 101 downwardly with respect to FIG. 7. The double flexion members of the outer spring arm 41 and the outer spring arm 45 provides additional strength to the socket contact 91, and combined with the protection tab 57 provides a highly reliable, extremely low failure rate socket contact.

While the present invention has been described in terms of a socket contact, one skilled in the art will realize that the structure and techniques of the present invention can be applied to many similar appliances. The present invention may be applied in any situation where the goals of good electrical contact, structural integrity, and elimination of failure modes is desired, but where small size and high density is needed.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An electrical socket contact of electrically conductive material for receiving a male pin contact element and comprising:

a crimping portion having an insulation cover holding portion and a wire contact receiving portion;

a socket portion, connected to said crimping portion, having a base portion, a side wall portion depending from said base portion having a first end and a second end more adjacent said crimping portion than said first end of said side wall portion, an inner spring arm depending from said first end of said side wall portion and an outer spring arm depending from said second end of said side wall portion, a portion of said outer spring arm on an outside of a portion of said inner spring arm;

wherein said socket portion includes an outer spring base perpendicular to said second end of said side wall portion and to said outer spring arm and interposed between said second end of said side wall portion and said outer spring arm.

2. An electrical socket contact of electrically conductive material for receiving a male pin contact element and comprising:

a crimping portion having an insulation cover holding portion and a wire contact receiving portion;

a socket portion, connected to said crimping portion, having a base portion, a side wall portion depending from said base portion having a first end and a second end more adjacent said crimping portion than said first end of said side wall portion, an inner spring arm depending from said first end of said side wall portion and an outer spring arm depending from said second end of said side wall portion, a portion of said outer spring arm on an outside of a portion of said inner spring arm;

a spring base interposed between said first end of said side wall portion and said inner spring and having a first edge continuous with a first edge of said side wall portion at said first end.

3. An electrical socket contact of electrically conductive material for receiving a male pin contact element and comprising:

a crimping portion having an insulation cover holding portion and a wire contact receiving portion;

a socket portion, connected to said crimping portion, having a base portion, a side wall portion depending from said base portion having a first end and a second end more adjacent said crimping portion than said first end of said side wall portion, an inner spring arm depending from said first end of said side wall portion and an outer spring arm depending from said second end of said side wall portion, a portion of said outer spring arm on an outside of a portion of said inner spring arm;

wherein said inner and outer spring arms lie generally in a first plane, and further including a top wall generally lying in a second plane parallel to and overlying both said inner and said outer spring arms and said base.

4. The electrical socket contact as recited in claim 4 wherein said side wall portion is a first side wall portion and further comprising a second side wall portion adjacent and connected to said base portion and opposite said first side wall portion and wherein said second side wall portion is interposed between said top wall and said base portion.

5. The electrical socket contact as recited in claim 4 wherein said top wall has a protection tab curved in a direction of said inner spring arm to protect said inner spring arm from damaging contact from an insertion of a male pin member.

6. The electrical socket contact as recited in claim 1 wherein said inner spring arm has a main portion adjacent a sloping portion and an elevated portion adjacent said sloping portion for accommodating an end of said outer spring portion.

7. The electrical socket contact as recited in claim 1 and further including a back cover portion, depending from said base portion, and adjacent the connection of said crimping portion to said socket portion.

8. The electrical socket contact as recited in claim 1 wherein said socket portion and said crimping portion are continuous and formed from a single blank of material.

9. An electrical socket contact of electrically conductive material for receiving a male pin contact element and comprising:

a crimping portion having an insulation cover holding portion and a wire contact receiving portion;

a socket portion, connected to said crimping portion, having a base portion, a side wall portion depending from said base portion having a first end and a second end more adjacent said crimping portion than said first end of said side wall portion, an inner spring arm depending from said first end of said side wall portion and an outer spring arm depending from said second end of said side wall portion, a portion of said outer spring arm on an outside of a portion of said inner spring arm;

wherein said side wall portion is a first side wall portion and wherein said socket portion further includes a second side wall portion attached to said base portion and having a first end farther away from said crimping portion than a second end, a top wall portion attached to said second side wall portion and a back cover portion depending from a second end of said top wall portion; said first side wall portion, said base portion, said second wall portion, said top wall portion and said back cover portion forming a five sided enclosure and surrounding said inner spring arm and said outer spring arm and having an inside area bounded by said inner and outer spring arms, said base portion, said first side wall and said second side wall.

10. The electrical socket contact as recited in claim 2 wherein said top wall has a protection tab curved in a direction of said inner spring arm to protect said inner spring arm from damaging contact from an insertion of a male pin member.

11. The electrical socket contact as recited in claim 2, wherein said first side wall portion is lies at a right angle to said base portion along a first fold, said second side wall portion lies at a right angle to said base portion along a second fold, and said top wall lies at a right angle to said second side wall portion at a third fold.

12. The electrical socket contact as recited in claim 11 wherein said socket portion further includes a plurality of slots, and wherein at least one slot is associated with each of said first, second and third folds, said plurality of slots for facilitating said first, second and third folds.

13. The electrical socket contact as recited in claim 12 wherein said socket portion further includes a closure flap portion attached adjacent said second side wall portion and along a fourth fold and one of said plurality of slots is associated with said fourth fold.

* * * * *